United States Patent [19]

Fraud et al.

[11] Patent Number: 4,791,852

[45] Date of Patent: Dec. 20, 1988

[54] MOBILE MORTAR FIRING UNIT

[75] Inventors: Michel Fraud, Velizy; René Donnard, Geispolsheim, both of France

[73] Assignees: Thomson-Brandt Arements, Paris; Lohr, S.A., Hangenbieten, both of France

[21] Appl. No.: 72,266

[22] PCT Filed: Oct. 14, 1986

[86] PCT No.: PCT/FR86/00350

§ 371 Date: Jun. 12, 1987

§ 102(e) Date: Jun. 12, 1987

[87] PCT Pub. No.: WO87/02446

PCT Pub. Date: Apr. 23, 1987

[30] Foreign Application Priority Data

Oct. 14, 1985 [FR] France ..... 85 15294

[51] Int. Cl.[4] ..... F41F 1/02; F41F 19/02

[52] U.S. Cl. ..... 89/40.02; 89/40.11

[58] Field of Search ..... 89/40.02, 40.11, 44.01; 280/28.5

[56] References Cited

U.S. PATENT DOCUMENTS

| | | | |
|---|---|---|---|
| 1,310,144 | 7/1919 | Schneider | 89/40.11 |
| 1,894,680 | 1/1933 | Goebert | 89/40.11 |
| 2,199,392 | 5/1940 | Dabrasky | 89/40.11 |
| 2,818,781 | 1/1958 | Ruf | 89/40.02 |
| 3,112,674 | 12/1963 | Jasse | 89/40.02 |
| 4,489,639 | 12/1984 | Winkler et al. | 89/40.02 |
| 4,708,051 | 11/1987 | Argon | 89/40.02 |

*Primary Examiner*—David H. Brown

*Attorney, Agent, or Firm*—Schwartz & Weinrieb

[57] ABSTRACT

The mobile unit makes it possible to fire a plurality of shots rapidly, and to leave the firing location immediately afterwards. The unit includes a carrier vehicle (1), a mortar (2) mounted via an articulation unit (4) on a base plate (6). Means are provided for rapidly setting the base plate on the ground so as to rest thereon during shooting. The aforesaid means may pull up the aforesaid plate so that the vehicle may move away rapidly from the shooting location. The primary object of these means is to provide the carrier vehicle with a retractable suspension which makes it possible to lower the vehicle to the ground. An elastic connection (8) is provided between the base plate (6) and the frame (7) of the carrier vehicle to provide for relative movement between the assembly made up of the mortar and the base plate on the one hand, and the frame, on the other hand. The aforesaid invention is of interest to military vehicle manufacturers.

9 Claims, 4 Drawing Sheets

MOBILE MORTAR FIRING UNIT

The invention relates to a light mobile mortar firing unit, particularly to a mortar of great power.

Due to the absence of any internal mechanical attenuation system for ballistic shots of great range, the mortars have a fire recoil force, which is of a considerable value.

The short duration of application of that force renders it even more dangerous for the material of the carrier.

In a general manner, a mortar is mounted on a base plate by means of which it is supported on the ground during fire. It is generally positioned by means of a bipod assembly. In order to stabilize the assembly at the moment of fire, the plate has a distinct shape with three edge projections in a star-arrangement along the principal directions of thrust. The anchorage of this type of a base plate in the soil ensures a sufficient stability so as to guarantee a great precision of fire. In the case of a self-propelled mortar mounted on a train of two wheels, the mortar is always supported on the base plate, and the bipod assembly is constituted by the train of wheels. The plate forwards and transmits the recoil energy to the ground with a maximal efficiency.

The necessity in combat of a parry and thrust at a distanct leads, for reasons of efficiency and security, to a desire for self-propelled units of fire having great mobility.

The mobility dictates a choice of rather light vehicle, as heavy carrier vehicles, which are effectively capable of absorbing the recoil of the mortar without damage, are only of little interest, as they constitute a choice target in view of their dimensions and characteristic slowness.

Furthermore, their high costs do not permit a nation to assemble a sufficient stock, so as to guarantee a certain efficiency of a mortar offensive.

The present invention permits reconciliation of the imperative demands of cost, and mobility and mechanical construction to resist damage from the brutal and violent recoil power of a mortar.

It is an object of the invention to confer to a fire unit the necessary rapidity of emplacement and removal from the fire zone in a manner so as not to constitute a potential return target after shots have been fired.

For this purpose, the present invention relates to a mortar fire unit including a carrier vehicle and a mortar mounted on a base plate characterized in that the carrier vehicle has a retractable suspension permitting a rapid descent of the chassis, and by the base plate being connected to the chassis or frame of the vehicle by means of a shock-absorbing mounting.

The vehicle's mobility assuring an efficient exit speed from the zone of fire, and the terrain characteristics of the carrier vehicle also permitting its rapid emplacement, constitute the principal advantages of the present invention.

Furthermore, the volume and the light weight of this vehicle do not carry with it the cost of equivalent heavy units, also suitable to carry this type of armament.

Other characteristics and advantages of the invention will appear from the description which is provided by way of an example, and accompanies by Figures in which.

The mobile firing unit, according to the invention, consists of an all-terrain light carrier vehicle, either of the caterpillar type, or of a wheel train. This vehicle in particular is equipped with a retractable suspension of a pneumatic, mechanical, electic or other type, which permits lowering of the frame so as to obtain a support in contact with the ground during the firing position, and wherein the aforesaid support is connected in an elastic manner with the frame, or with another support carrying the mortar.

A first embodiment mode is shown in FIGS. 1–4. The subsequent Figs. show the second type of embodiment.

Although a selection was made to represent these two types on distinct vehicles, namely on caterpillar type vehicles, and then on vehicles equipped with wheels, it is not intended to confer any limitation whatsoever on the type of vehicle proper for each mode.

Figure 1:
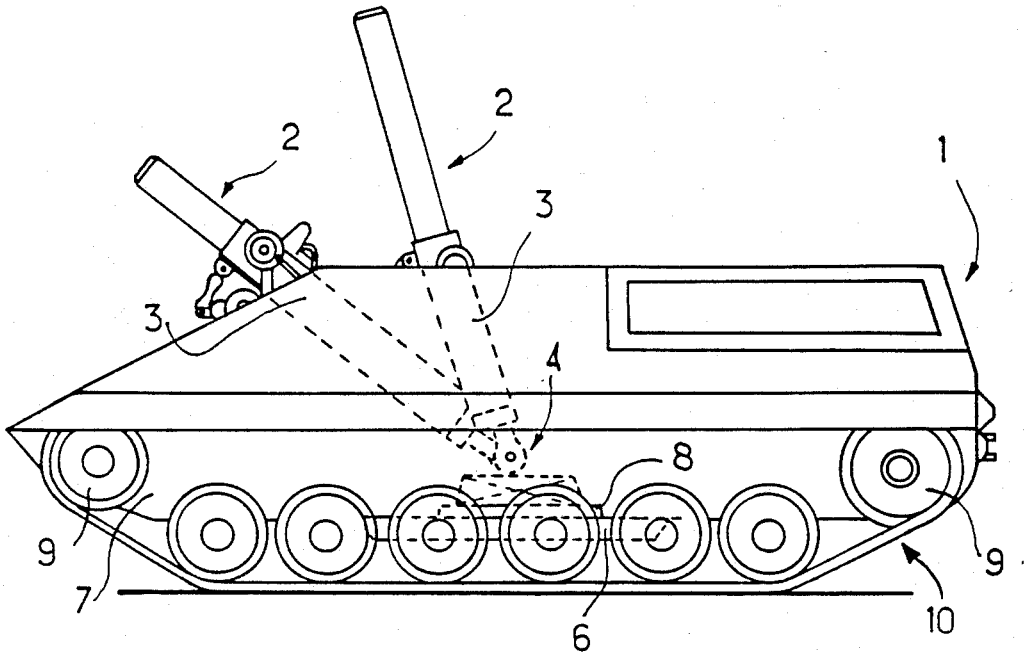
FIG. 1 is an elevation view of the firing unit, according to the present invention, in a traveling position.

Referring now to FIG. 1, the mobile firing unit, according to the invention, consists of an all-terrain light carrier vehicle 1, which may be equipped with caterpillar type chains, or with a train of wheels. A mortar 2 is articulately mounted on the vehicle by mounting means such as its barrel 3. The latter rests by means of an articulated joint 4 on a flange 5, integral with a base plate 6 connected to a central portion of the frame 7 of the carrier vehicle 1.

As has been already indicated, one of the principal characteristics, according to the invention, consists in the provision of a retractable suspension of the vehicle, which permits the base plate 6 to be put quickly in contact with the ground, namely so as to provide a support following shots. This suspension also permits re-mounting of the mortar and the plate assembly so that the unit can be rapidly disengaged from a firing emplacement.

Figure 2:
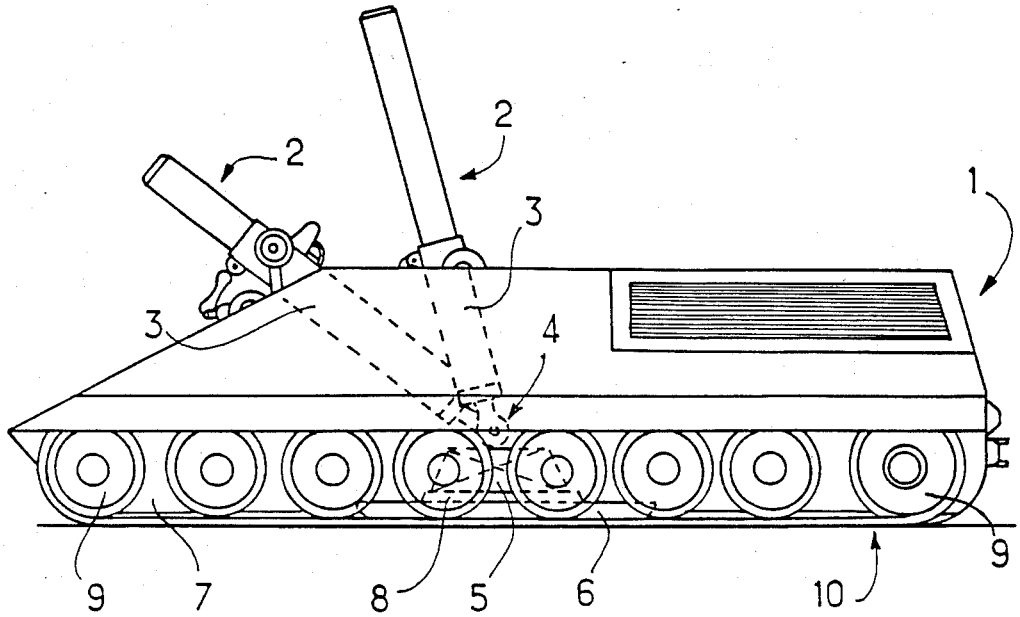
FIG. 2 is an elevation view of the firing unit, according to the present invention, in the firing position.

In FIG. 2 the plate 6 is in contact with the ground. In a preferred mode, it is not rigidly connected to the frame 7, but is provided with an elastic coupling 8 for shock-absorbing purposes. This coupling can be implemented, for example by several coils of a metallic cable which are disposed in parallel. It permits, following a shot, a relative movement of the base plate with respect to the frame, and permits partial filtering of the mechanical effects transmitted by the mortar.

Figure 3:
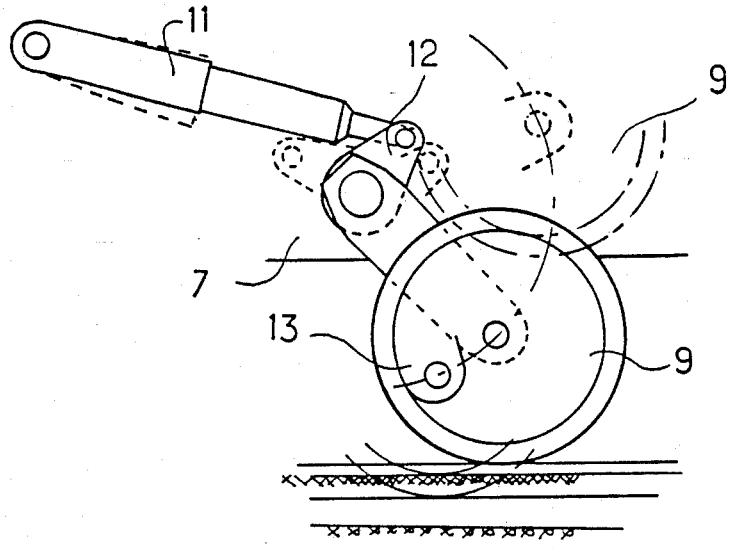
FIG. 3 is an elevation view of one type of retraction mechanism of the suspension of the firing unit used for caterpillar type vehicles.

One embodiment of this suspension is shown in FIG. 3. It carries on each side and on each wheel 9 for the chains 10, a pneumatic piston-cylinder mechanism 11 pivotally connected with its cylinder to the chassis, and acting through the intermediary of a lever 12 on one end of each adjacent suspension arm 13, the other end of the suspension arm being connected to an axle of a wheel pair so as to reduce the impact on the ground, by modifying the inclination of each arm to the horizontal. In this manner the vehicle can bear down rapidly, so as to permit firing preparations.

At the end of the shots, and by a reverse movement, the chassis is re-assembled, and the firing unit can travel along a course on each terrain.

The base plate 6 may have different forms and shapes. For this purpose, in particular, several webs in the form of arches 14 connected to fulcrums 15 are provided.

In the case where the vehicle fires a shot from the ground which has a long duration, it is possible to profit from the inertia due to the mass of the vehicle, so as to totally supress the effect of the recoil. In this case, the vehicle is supported on the base plate.

To the contrary, on a more pliable soil, the mass of the vehicle could favor anchorage, and consequently stabilization of the base plate on the ground, so as to, in the event of a shot of low incidence, avoid gliding or skidding.

In a general manner, the invention permits in an efficient manner shock-absorption of the violent effects of a shock wave subsequent to the firing, which effects are transmitted practically entirely to the ground.

Figure 4:
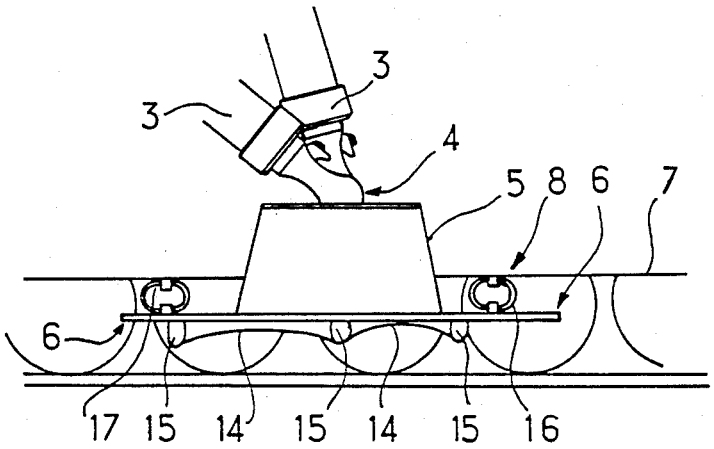
FIG. 4 is an elevation view of an embodiment of the mounting of a mortar on a caterpillar type vehicle.

In FIG. 4 it can be seen in a more detailed manner how the assembly constituted by the mortar 1 and the base plate 6 can be mounted in a shock-absorbing manner on the vehicle. The elastic coupling 8 can be implemented with the aid of at least two resilient coils 16 and 17 of a metallic cable which constitute elastic rings connected to one another by transversely extending elements. The plate 6 is suspended lightly from the chassis 7 in such a manner that when the vehicle bears down, due to its retractable suspension, the base plate is systematically induced to make contact with the ground.

The flange 5 is solid with the base plate 6 through the intermediary of a reinforced mechanical connection, which improves the good connection between the base of the mortar, and the aforesaid base plate.

Figure 5:
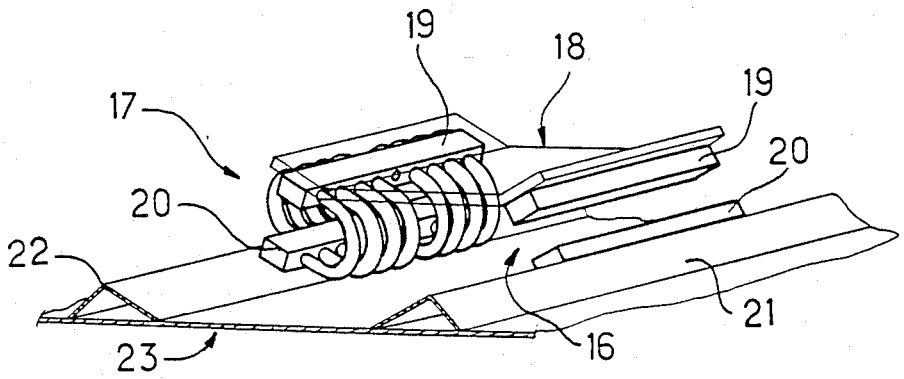
FIG. 5 is a perspective view of the elastic shock-absorbing cable coupling disposed between the mortar support, and the bottom of the frame, used in particular in the case of a vehicle having a wheel assembly.
Figure 6:
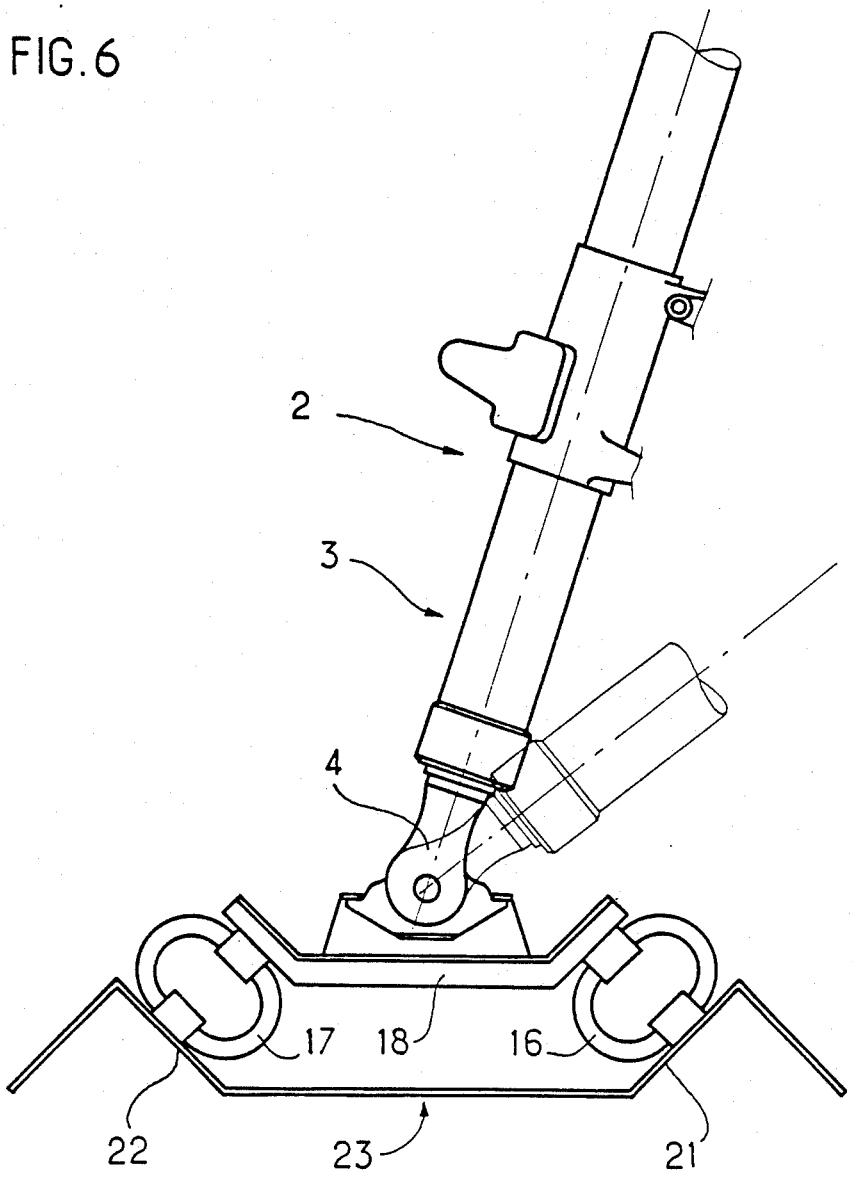
FIG. 6 is an elevation view of an embodiment of the mounting of the mortar on a vehicle equipped with wheels.

An example of this type of suspension is shown in FIG. 5. It will be described in detail hereinafter.

The other type of implementation shown in FIGS. 5–8 consists in an adaptation of the barrel of the mortar on a base plate 18 supported by the chassis, on which it is floatingly mounted, for example by a suspension in the form of an elastic coupling of the same type as that of the preceeding coupling, namely in the form of two transverse coils 16 and 17, of a helical metallic cable whose coils are connected to one another by longitudinal support elements 19 and 20, respectively, which are integral with the base support 18 of the mortar, and two projecting structures 21 and 22 conforming with, or set down on the base 23 of the chassis of the carrier vehicle.

The coil means 16 and 17 are preferably disposed transversely on the vehicle 1', one in front, and the other in the rear along the the entire length of the vehicle.

The longitudinal support elements 19 and 20 are cross-bars provided with transverse perforations, which receive the respective helical coils.

In this manner an elastic suspension assembly is obtained, which in particular functions as a very efficient shock-absorbing means, which allows a rapid neutralization of all violent affects caused by the firing.

Figure 7:
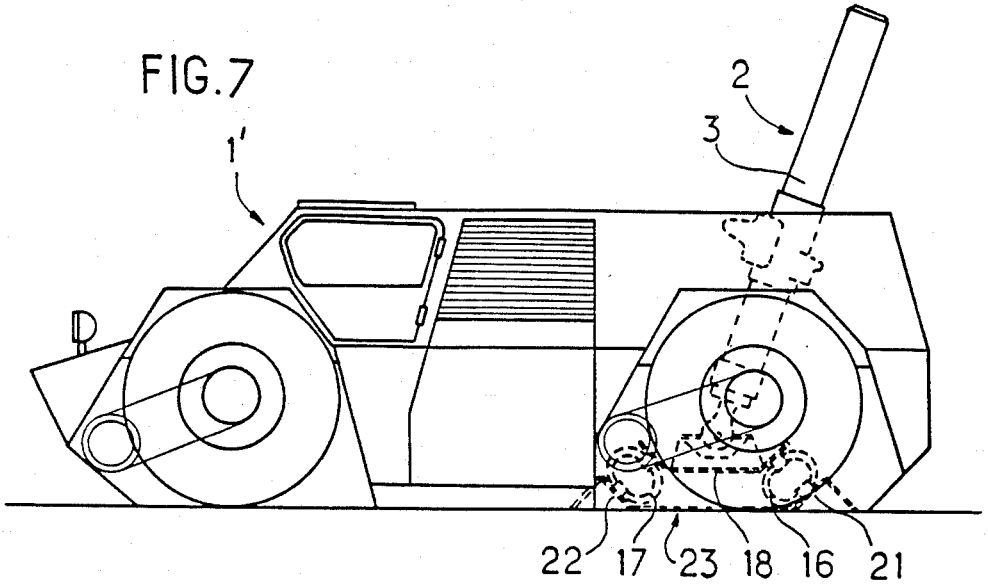
FIG. 7 is a schematic elevation view of the firing unit on wheels, according to the invention, in a firing position equipped with the mechanical assembly shown in FIG. 6.
Figure 8:
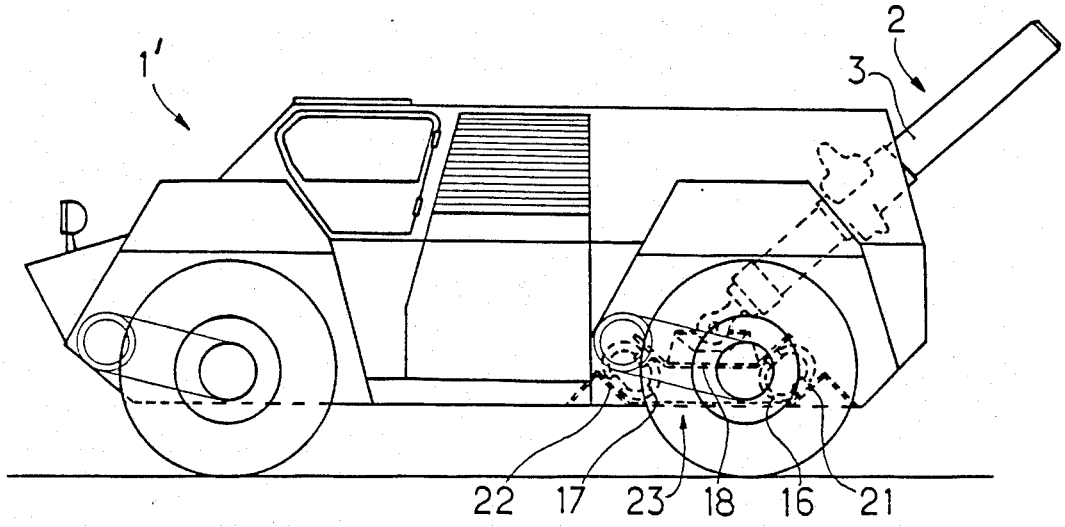
FIG. 8 is a schematic elevation view of the firing unit on wheels, according to the invention, in a traveling position.

As can be seen in FIG. 7, in position for a shot, the vehicle suspension is lowered until the base 23 of the chassis makes contact with the ground, so as to obtain a support surface and lateral stabilization on the ground.

The total base surface, constituting the support for the ground, but in particular the elastic suspension, which functions as a very effective shock-absorber, suffices to support all mechanical effects without any damage, and to absorb successive shock waves from the firing at low incidence.

The firing unit, according to the invention, can undergo certain technical variations and variants and modification of a secondary order, without exceeding the scope of the present invention. Furthermore, direct variants, substitution by equivalent materials or means, addition of inoperative elements or other modifications without inventive intent are perfectly within the scope of the present invention.

We claim:

1. A mobile mortar carrier, comprising in combination, a carrier vehicle having a chassis, downwardly displaceable and upwardly retractable suspension means connected between said carrier and said chassis, a mortar, mortar mounting means for mounting said mortar, a base plate located below said mortar mounting means, elastic coupling means located below said mortar, and being connected to said chassis and to said base plate, so that said elastic coupling means acts as a shock absorber when said chassis is displaced downwardly by a recoil of said mortar, and said base plate makes contact with the ground.

2. The mobile carrier according to claim 1, wherein said suspension means is of a pneumatic type.

3. The mobile carrier according to claim 2, wherein said carrier has a plurality of wheels pairs, and said suspension system of the pneumatic type includes a piston-cylinder mechanism pivotally connected near one end thereof to said chassis, and pivotally connected near another end thereof to one end of lever means, suspension arm means pivotally connected with one end thereof to another end of said lever means, another end of said suspension arm means being pivotally connected to an axle of one of said wheel pairs.

4. The mobile carrier according to claim 1, wherein said base plate is shaped on the underside thereof so as to render it laterally stabilized when in contact with the ground.

5. The mobile carrier according to claim 4, wherein said base plate includes a plurality of ribs extending approximately parallel with the wheel axles, said ribs being connected to one another by respective convex arches.

6. The mobile carrier according to claim 1, wherein said elastic coupling means includes two coils located near opposite ends of said base plate so as to floatingly connect said base plate to said chassis.

7. The mobile carrier according to claim 6, wherein said longitudinal support elements are integral with said base and said mortar mounting means, respectively.

8. The mobile carrier according to claim 6, further comprising two longitudinal coil support elements for each of said coils, said longitudinal coil support elements being connected with said base plate and with said chassis, respectively, each coil being constituted by turns of metallic cable.

9. The mobile carrier according to claim 7, wherein said turns of the metallic cable pass through perforations in said longitudinal coil support elements.

* * * * *